US010506837B2

(12) United States Patent
McCormick

(10) Patent No.: US 10,506,837 B2
(45) Date of Patent: Dec. 17, 2019

(54) SLIDE ON NECKTIE

(71) Applicant: Rick McCormick, Newport Beach, CA (US)

(72) Inventor: Rick McCormick, Newport Beach, CA (US)

(73) Assignee: Rick McCormick, Newport Beach, CA (US)

( * ) Notice: Subject to any disclaimer, the term of this patent is extended or adjusted under 35 U.S.C. 154(b) by 159 days.

(21) Appl. No.: 15/686,050

(22) Filed: Aug. 24, 2017

(65) Prior Publication Data

US 2019/0059480 A1 Feb. 28, 2019

(51) Int. Cl.
*A41D 25/02* (2006.01)

(52) U.S. Cl.
CPC ..... *A41D 25/027* (2013.01); *A41D 25/022* (2013.01)

(58) Field of Classification Search
CPC .... A41D 25/02; A41D 25/022; A41D 25/025; A41D 25/027
See application file for complete search history.

(56) References Cited

U.S. PATENT DOCUMENTS 1,363,888 A * 12/1920 Lewers ..... A41D 25/027 24/60
1,459,926 A * 6/1923 Orsi ..... A41D 25/027 24/56
1,487,126 A * 3/1924 Stubbins ..... A41D 25/027 24/56
2,128,840 A * 8/1938 Molitor ..... A41D 25/027 2/153
2,504,887 A * 4/1950 Eben ..... A41D 25/027 2/153
4,173,792 A * 11/1979 Intengan ..... A41D 25/025 2/144
4,318,189 A * 3/1982 Intengan ..... A41D 25/025 2/144
2005/0204450 A1* 9/2005 Dayan ..... A41D 25/02 2/148
2014/0283278 A1* 9/2014 Jordan ..... A41D 25/02 2/145
2014/0317831 A1* 10/2014 Woody ..... A41D 25/025 2/152.1
2015/0366297 A1* 12/2015 Taetzsch ..... A44B 1/04 24/59

* cited by examiner

*Primary Examiner* — Christopher R Harmon

(57) ABSTRACT

One embodiment of a thin, flat, and angular triangular device for an improved necktie having on one edge a lead-in notch (10) which merges into a button passage (12) before merging into a cove (22). Two bridges (14), made of a flexible material so that they can be repeatedly bent without fracturing, are on ledges on top of the opposite edge from the lead-in notch (10). An untied, shortened necktie (30) is threaded through a false knot (24) and then threaded through the tie slot (26) at the top of the device. This allows the necktie to be joined to the Tiekeeper (28) device. This necktie device slides over the top shirt button by way of the lead-in notch and button passage before resting in the cove on top of the threads of the shirt's top button. Other embodiments are described and shown.

10 Claims, 6 Drawing Sheets

SLIDE ON NECKTIE

CROSS-REFERENCE TO RELATED APPLICATIONS

This application claims the benefit of provisional patent application Ser. No. 62/378,365, filed 2016 Aug. 23 by the present investor.

BACKGROUND

Prior Art

The following is a tabulation of some prior art that presently appears relevant:

U.S. PATENTS

| Pat. No. | Issue Date | Patentee |
|---|---|---|
| 8,056,147 | 2011 Nov. 15 | Patel |
| 5,337,457 | 1994 Aug. 16 | Chennault |
| 8,143,482 | 2006 Dec. 06 | Sens-Grosholz et al. |
| 6,550,109 | 2003 Apr. 22 | Sims |
| 4,504,979 | 1985 Mar. 19 | Kawamura |

BACKGROUND OF THE INVENTION

This invention relates to neckties, specifically, a device which anchors an unknotted necktie onto the threads of a shirt's top button.

Before there were neckties, only people of wealth wore fancy fabrics around their necks which indicated their state in society. This ostentatious use of fabric was used to create cumbersome, bulky, collar garments which can be found in numerous paintings by the likes of Rembrandt, Hals, and Codde. Many of these expensive, custom-made garments served no true functional purpose, other than to be decorative, which is still the case to this day. Bach in the day, only the affluent could purchase these handmade items.

Over time, neckties became more affordable with the general public and not so embarrassing to wear as the smaller size became more acceptable and fashionable. In the last one hundred years, neckties have become as important piece of a man's formal wardrobe. Today, neckties continue to be worn mostly for formal occasions and professional work environments and are a way of expressing oneself.

Recently, with the younger generations, the necktie has not been thought of as a necessity and appears to be on a death march into complete obsolescence. More and more men and boys do not know how to tie a necktie—and they don't care to learn. If they are required to wear a necktie for work, many are keeping their neckties in a noose so they don't have to waste time tying their necktie every time they wear one. While it may be convenient to leave a necktie in a noose, it is bad for the structure and material comprising the necktie.

More and more men are excluding neckties from their wardrobe as it is now becoming acceptable to attend work, weddings, funerals, and other formal occasions without wearing neckties. Casual Fridays, telecommuting, and conference calling are quickly becoming the norm and don't necessarily require neckties. The scruffy beard, unkempt hair, loosely fitted necktie, or no necktie at all look, is the trend today and does not appear to be waning.

A few necktie devices have been proposed—for example, in U.S. Pat. No. 8,056,147 to Patel (2011), U.S. Pat. No. 5,337,457 to Chennault (1994), and U.S. Pat. No. 7,143,482 to Sens-Grosholz, et al. (2006). None of them, uses a quick slide on device on the threads of a top shirt button. The first two both pertain to keeping a necktie adhered to the mid-section of a shirt, so when one moves or bends forward the necktie does not swing away from the body. Both also require the wearer to consume time by tying the necktie. Both also require the waste of time and hassle of engaging the back of the neckties to shirt buttons in the waist area. By anchoring the necktie to the shirt buttons in the waist area, the wearer is constricted as he does not have the freedom of movement. The wearer, therefore, gives up the freedom of movement just so they can have their necktie always close to their body. So with these two patents, not only is there the feeling of constriction in the neck, but also in the stomach region. The third one, Sens-Grosholz, et al., is a button for a necktie. It is comprised of a front button part on the front necktie which attaches to a rear portion which holds the necktie in between the two said parts. A clip on the rear part is then clipped to the shirt to hold the necktie in place. Something that is clipped onto anything is susceptible to movement, dislodgement, or falling off completely. It is not integrated within the necktie itself in the manufacturing process, but separate from it until the user engages the button into said necktie, thus the necktie could fall off more easily. The fourth one, Sims, has nothing to do with a necktie, but rather a button latch device for enhancing the fastening of the top button of a dress shirt. It is basically a hook that engages the top button of a shirt. The fifth one, Kawamura, comprises a clasp-like device in the noose of a necktie which allows the wearer to clasp one noose end with the other without having to tie a necktie. There is still a necktie that goes under the collar and around the wearer's neck.

Neckties that have to be tied in a knot suffer from a number of disadvantages:

(a) The agonizing feeling of strangulation with a noose around one's neck is more than most men can handle for periods at a time, such as an eight-hour work shift.

(b) The amount of wasted time one spends tying, loosening, and untying a necktie.

(c) There is no guarantee that once the necktie is finally tied that it will be the proper length that is, that the longer, wider part of the necktie will reach exactly with the belt buckle. If the necktie is not the proper length it must be untied and retied again until the proper length is achieved.

(d) The user has to know the complicated procedure of how to tie a necktie until said procedure is learned, usually through muscle memory.

(e) Neckties are a waste of material as they use approximately one-quarter to one-third more material than the slide on, shortened, pre-shaped neckties with the Tiekeeper device.

(f) They have the tendency to be left in a noose by the wearer, so that the user doesn't have to constantly tie a necktie every time a necktie is worn. This is not good for the structure or the material of the necktie.

(g) The loss of dexterity, especially with the elderly or disabled, can make tying a necktie difficult after having already taken on the sometimes-difficult task of buttoning the top button of a collared shirt.

(h) Neckties are notorious for being filthy germ magnets which are handled and then worn in close proximity to the wearer's Danger Triangle of the Face, which is the area located around the nose and mouth, but are rarely professionally cleaned.

ADVANTAGES

Accordingly, several advantages of one or more aspects are as follows: to provide neckties that can be put on and taken off very quickly, that are much more comfortable, that are consistently the correct length, that require much less material, that the user does not have to know how to tie a necktie, that is safer around machinery, that the user does not have to keep in a noose so the material will not be ruined, that will remain securely to the wearer and not fall off to embarrass said wearer, and that the user never has to tie. These and other advantages of one or more aspects will become apparent from a consideration of the ensuing description and drawings.

SUMMARY

In accordance with one embodiment, a necktie assembly comprises a flat body having a lead-in notch, a bridge portion, and an angled, convex shield body.

DRAWINGS—FIGURES

In the drawings, closely related figures have the same first numeral, but different alphabetic suffixes.

DRWAINGS—REFERENCE NUMERALS

10 Lead-in Notch
12 Button Passage
14 Bridge
16 Edge
18 Knot tip
20 Shield Section
22 Cove
24 False Knot
26 Tie Slot
28 Tiekeeper
30 Shortened Necktie
32 Butterfly Section
34 Knot Hole
36 Rectangular Section

DETAILED DESCRIPTION—FIGS. 1A to 1D, 3, 4, AND 5—FIRST EMBODIMENT

Figure 1A:
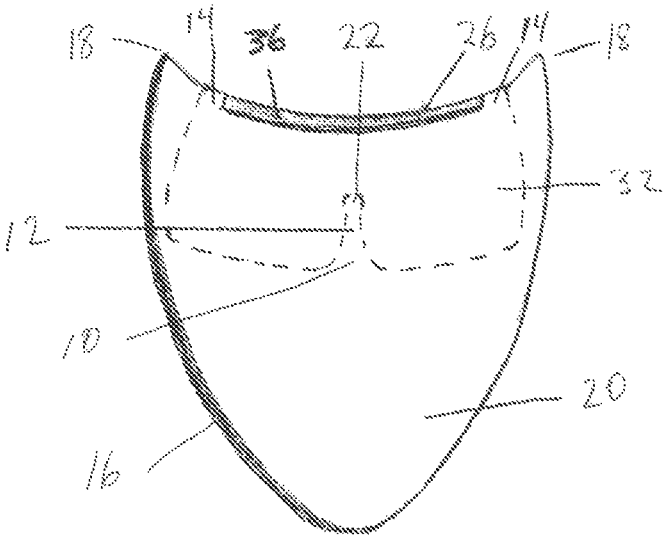
FIGS. 1A and 1D are perspective views of a slide on device with a regular lead-in notch opening, standard passage slot, and angular triangle, or shield, of one embodiment.

One embodiment of the Tiekeeper (28), or slide on device, is illustrated in FIG. 1A (front view). Other end views Include FIG. 1B (bent view), FIG. 1C (standing side view), and FIG. 1D (top view). The Tiekeeper (28) is shown to be convex in shape which allows it in mimic the look of a conventional necktie and to fit around the contour of the shirt's collar. The device has a thin base edge (16) consisting of a flexible sheer of material which can be repeatedly bent without breaking. In one embodiment, the base is a flexible plastic, such as polyethylene. The base can consist of any other material that can be repeatedly bent and run break, such as vinyl, leather, rubber, polypropylene, various plasticized materials, laminated fibrous materials, steel, cardboard, etc.

At one edge is a lead-in notch (10), which is the accepting point of the button threads of the shirt's top button. The lead-in notch (10) narrows into a button passage (12). The button passage (12) eventually opens into the cove (22) which is the final resting place of the Tiekeeper (28) on the threads of a top shirt button. Between the two bridges (14) is the tie slot (26) which is where a shortened necktie (30—FIG. 5) made of a flexible material, preferably fabric (textile, silk, wool or polyester), passes through. The knot tips (18) are located on the outside of the bridges (14) and can hold the false knot (24—FIG. 5) in place.

The Tiekeeper (28) is made up of three sections: a butterfly section (32) at the back, a narrow rectangular section (36) at the top, and a triangular shield section (20) in front. The butterfly section (32) and the shield section (20) are joined by two flexible bridges (14) in the rectangular section (36). The front of the device is triangular or shield shape to give it the appearance of a regular necktie, and so that it may be hidden behind or within the similarly pre-shaped, false knot (24—FIG. 5) portion of the slide-on necktie.

The base, or butterfly section (32) of the Tiekeeper (28), is the section which rests on the button threads of the shirt's top button and is generally 0.1 mm to 0.5 mm in thickness, as is the entire Tiekeeper (28) device. The butterfly section (32) is approximately 2.5 cm×5 cm long and 1 cm×3 cm wide.

The lead-in notch (10) has an opening width of roughly 1 cm. It has a length of approximately 0.25 cm. to 0.50 cm. The button passage (12) is roughly 0.30 cm to 0.60 cm. in width and generally 0.50 cm. to 1 cm, in length. The cove (22) has a diameter of approximately 0.35 cm.

The rectangular section (36) is comprised of the two bendable bridges (14) and the tie slot (26). The bridges (14) are approximately 0.50 cm to 1.0 cm long and 0.2 cm and 1 cm wide. The tie slot (26) opening is approximately 3.0 cm to 5.0 cm long and roughly 0.30 cm to 1.5 cm wide.

The shield section (20) is approximately 2.5 cm×6.5 cm long and 3.0 mm×7.0 cm wide. The shield section (20) is convex in shape to give it the appearance of a conventional necktie knot—once the false knot (24—FIG. 5) is slid over it. Generally speaking, the larger the shield section is, the larger the false knot will be on the necktie.

FIG. 3

Figure 3:
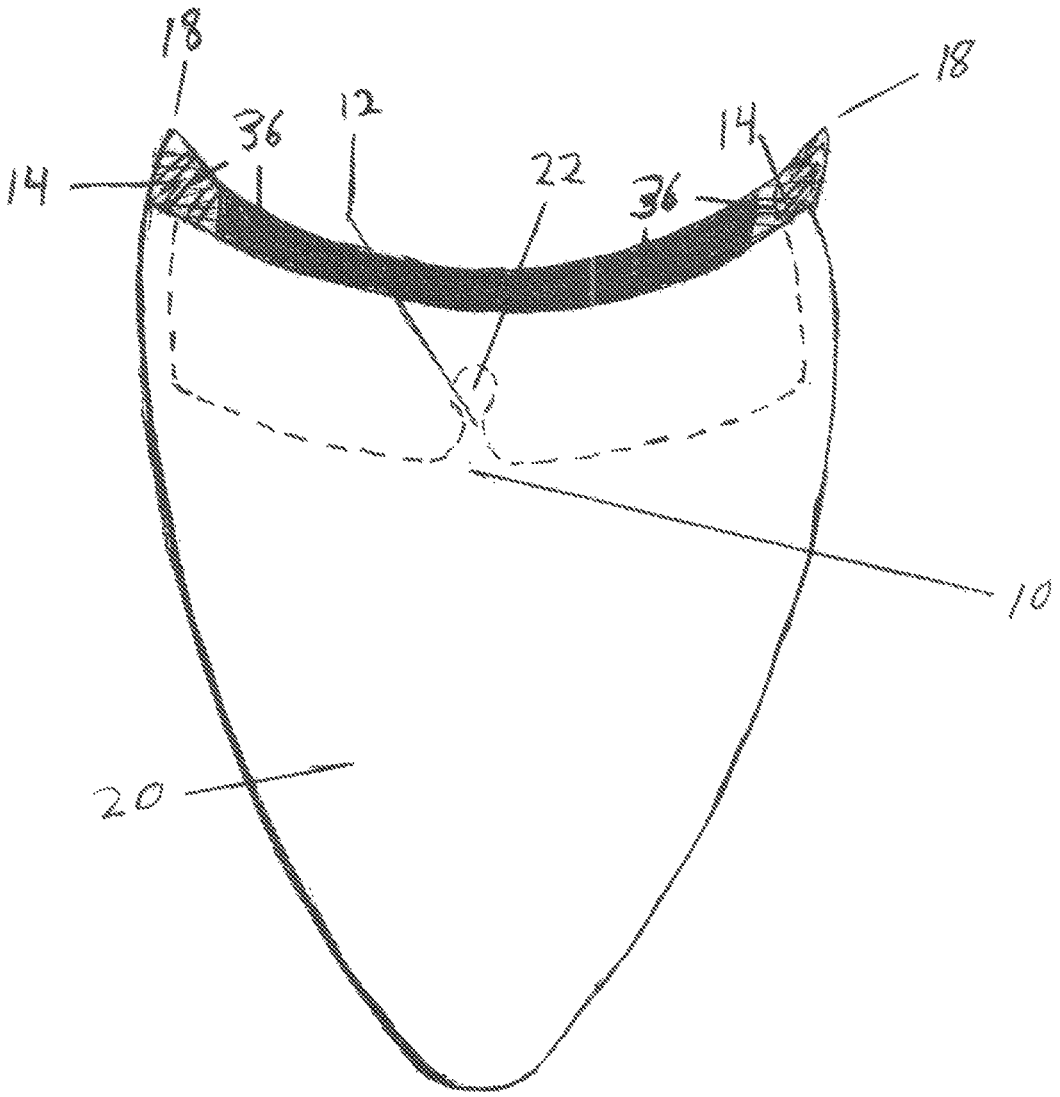
FIG. 3 shows a large, front view of the Tiekeeper device with numbered parts.

FIG. 3 shows a blown-up version of the Tiekeeper (28) in order to give a better view of the lead-in notch, the button passage (12), the cove (22), and the bridges (14).

FIG. 4

Figure 4:
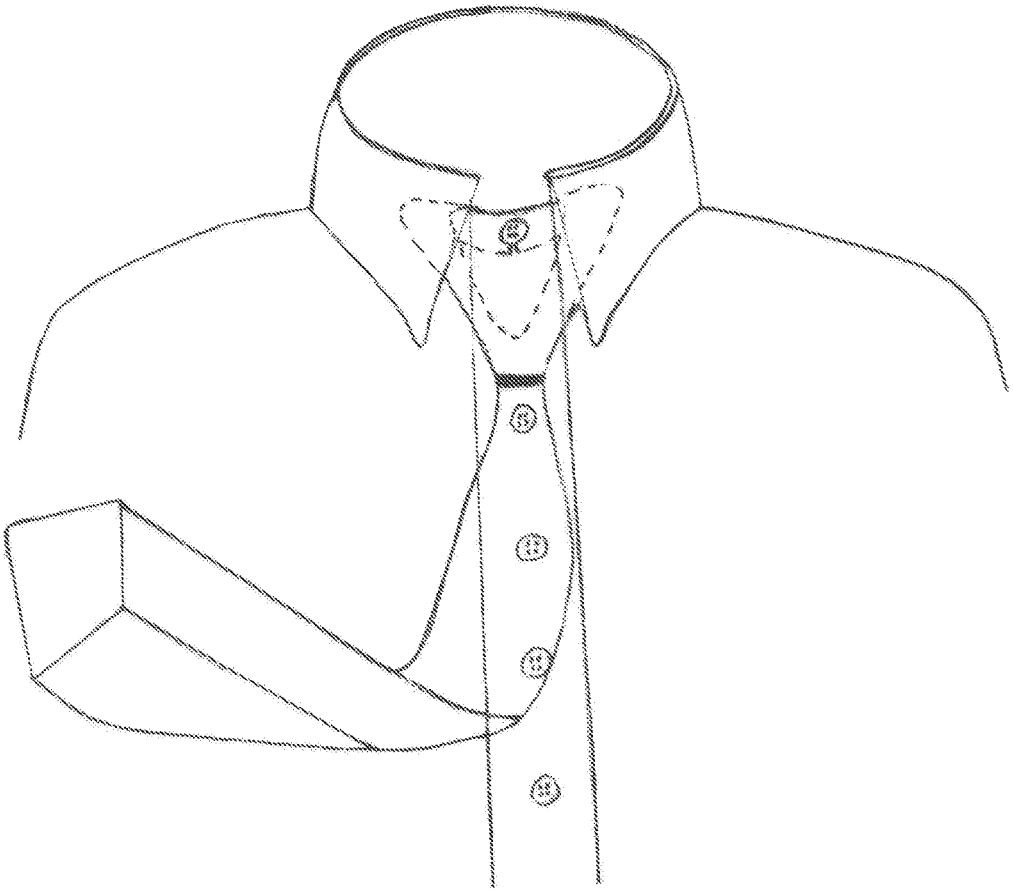
FIG. 4 shows a front view of the slide on necktie and device when anchored to the top button of a dress shirt.

FIG. 4 shows the slide on necktie and Tiekeeper device (28) on a dress shirt. There is not a necktie which goes around the collar. The figure shows the slide on device resting on the top threads of the top shirt button. When the collar is put back down, the device is hidden and stays securely in place.

FIG. 5

Figure 5:
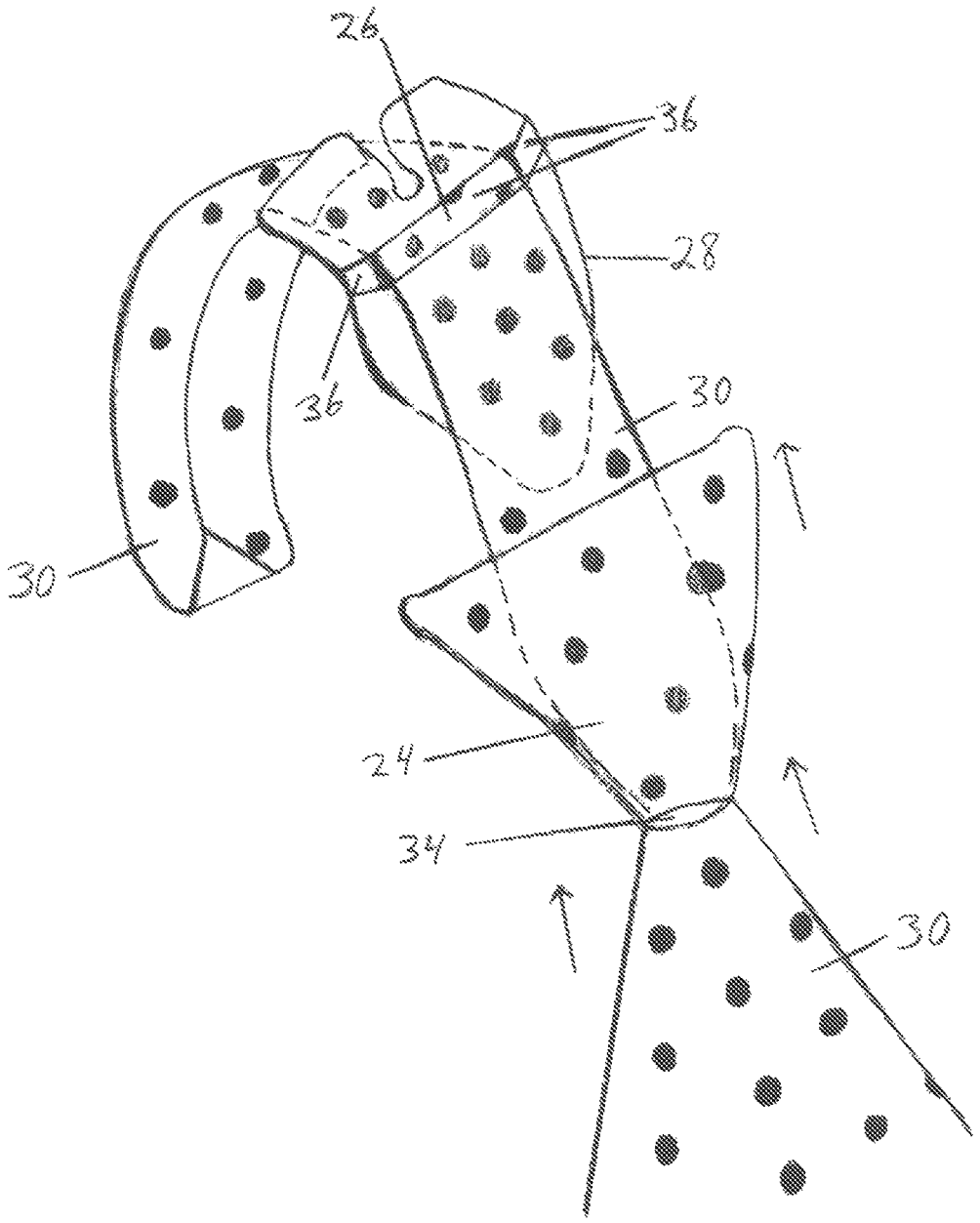
FIG. 5 shows a front view of the shortened necktie and false knot with the Tiekeeper, or slide on device with numbered parts.

FIG. 5 shows the three main sections of a partially assembled slide on necktie: the Tiekeeper (28), the shortened necktie (30) part of the necktie which comprises the majority of the tie, and the false knot (24), which resembles the knotted portion of a standard necktie. The false knot (24) is a façade and not really a knot in the true sense of the word as it is not tied together as with the method of tying a conventional necktie. It is a pre-shaped, elastic band, not unlike an elastic hair band, but instead of being cylindrical in shape like most hair bands, it is triangular or necktie knot-shaped. At the bottom of the false knot (24) is the knot hole (34), which is where the shortened necktie (30) passes through before being slipped through the tie slot (26).

Operation—FIGS. 1, 3, 4 and 5

The narrow end of a shortened necktie (30) is slipped through the knot hole (34) located at the bottom of the false knot (24). The narrow end of the shortened necktie (30) is then pulled up through the false knot with the front of the tie lined up with the front of the false knot (24) before being slipped down through the tie slot (26) of the rectangular section (36). The wider end of the necktie is draped over the shield section (20) at the front of the device. The length of the necktie is checked to make sure it is the proper length, which should, be down to the belt buckle. If it is too long, more of the narrow end can be pulled through the tie slot (26). If the necktie is too short, it can be lengthened by pulling back out some of the tie's narrow end from the tie slot (26). Once the necktie has passed through the tie slot (26) and the length has been determined to be correct, the false knot is pulled over the shield section (20). The false knot gives the appearance of a standard knot and hides the Tiekeeper device. A small remainder of the narrow necktie end (maybe three to six inches) will hang down hidden from view behind the wider necktie end. This section can be left dangling out of sight, tucked into a keeper loop, or tucked into the false knot.

The simple manner of using the Tiekeeper (28) device is not similar to the manner of a conventional necktie, because, other than the looks, it is like no other necktie. For an assembled slide on necktie, the wearer first buttons the top button of his or her shirt and pulls up the collar so that it is standing. The wearer then holds the outer edges of the butterfly section (32), Tiekeeper (28), or the false knot (24) area using the thumb and either the forefinger or middle finger, so that the back of the necktie with the butterfly section (32) faces the wearer. The wearer simply slides the butterfly section (32) down behind the top shirt button. The wearer does this by guiding the lead-in notch (10) through the button passage (12) until it is reaches the cove (22) and is resting on top of the threads of the shirt's top button. If the device doesn't immediately slide onto the button threads due to tight button threads, the contour of the shirt collar, etc., the user can pinch in on the outer edges of the butterfly section (32), Tiekeeper (28), or knot area, so that the flexible butterfly section bows inward towards, or away from, the start's top button threads. The back of the butterfly section (32) should rest snugly on top of the shirt's top button threads between the front collar area of the shirt and the back of the top shirt button. Lastly, the shirt collar is pulled back down over the exposed knot tips (18). This helps secure the necktie and hides the fact that it is a pre-shaped, unknotted necktie. Once secured, the slide on necktie has the appearance, look, and feel of a conventional necktie.

To remove the slide on necktie, simply do the steps its reverse order. First, lift the shirt collar. Next, lift up the necktie from the knot area, if it doesn't easily slide off, the wearer can pinch the edges of the butterfly section (32) inward or outward so that the butterfly section (32) bows. Lastly, slide the device up and off of the threads of the top shirt button.

Figure 1B:
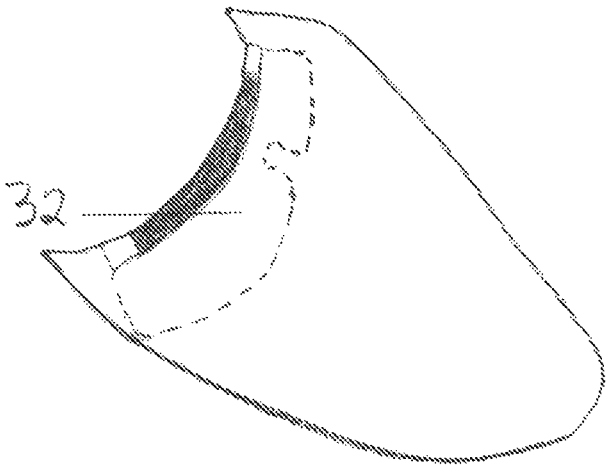
Figure 1C:
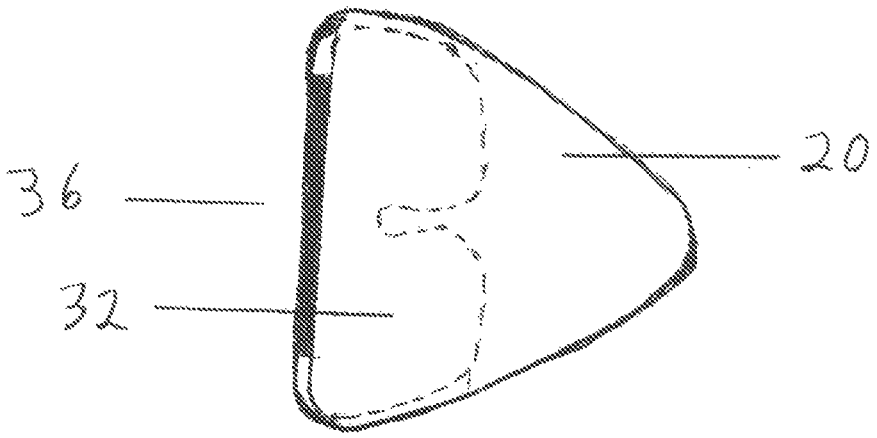
Figure 1D:
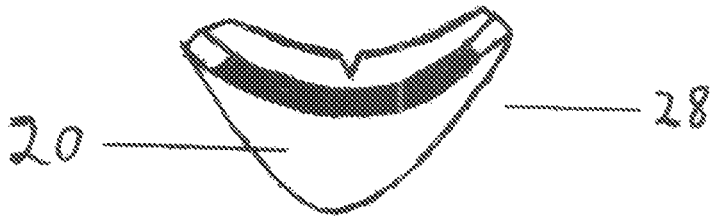

As shown in FIG. 1B, when the butterfly section (32) of the device is pinched outward, it makes it easier for the lead-in notch (10) to catch onto the button threads and slide the device into place.

Most times, the wearer does not have to pinch the butterfly section (32) in order to slide the necktie onto the top button threads, if the shirt has plenty of room, to fit one or two fingers between the wearer's neck and a buttoned shirt collar, the slide on device is generally easier to put on and take off.

Figure 2A:
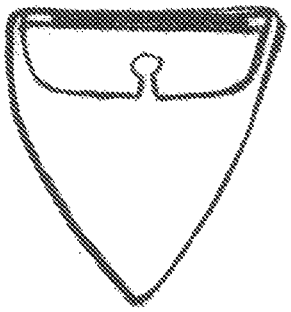
FIGS. 2A and 2B show a slide on device with from two different angles—a back view and an angled back view of another embodiment.
Figure 2B:
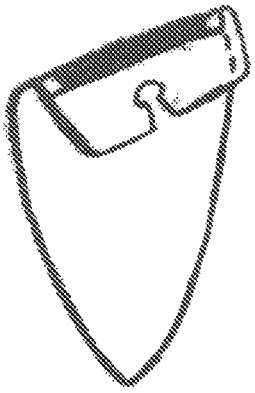

FIG. 2—Additional Embodiment

An additional embodiment is shown in FIG. 2 in which the Tiekeeper (28) has a flat butterfly section (32), a flat rectangular section (36), and a flat, angular shield section (20).

Advantages

From the description above, a number of advantages of some embodiments of my Tiekeeper necktie device become evident:

(a) The Tiekeeper can be put on and taken off quickly, as opposed to a standard necktie which is laborious and time consuming to tie, put on and take off.

(b) The wearer is much more comfortable without the strangulation feeling. This can lead to a less distracting, more productive work day.

(c) The Tiekeeper device uses less silk, wool, polyester, etc., so they are not expensive, and may even be less expensive than standard neckties.

(d) The user does not have to know how to tie a complicated tie for this slide on pre-shaped necktie. This is a big advantage for young people and others who never learned to tie a necktie, or have not tied a necktie in some time.

(e) The Tiekeeper necktie wearer never has to have the frustration of tying a necktie, only to find it being the improper length, and then having to retie the necktie until the proper length is obtained.

(f) The wearer will never again have to keep their neckties in a noose in order to keep from wasting their time tying neckties.

(g) Because the wearer only touches the sides of the device and necktie, there Is less handling, and thus, less of a chance of contracting germs or soiling said necktie.

(h) Because the front of the slide on necktie is made up of two separate sections (shortened necktie and the false knot), these portions can be their own color or design.

Conclusions, Ramifications, and Scope

Accordingly, the reader will see that the Tiekeeper necktie devices of the various embodiments can be used to quickly and conveniently put on or take off a necktie without having to tie or untie a necktie, and while maintaining a comfortable, professional look. There is no strangulation or asphyxiation feeling when wearing this easy on and easy off necktie. In addition, the Tiekeeper takes the hassle out of tying a knot, only to find it to be the improper length. This slide on necktie is always the proper length because the length of a man's torso does not change. Often, the reason neckties are too short or too long is because the wearer's neck size, or girth, has increased or decreased.

There is no excuse not to wear a necktie anymore now that one does not have to know how to tie a necktie, can be comfortable, have a nice look and feel, is able to put on or take off the necktie quickly, and not have to keep a germy item located in the close proximity to one's face.

While the above description contains specificities, they should not be construed as limitations the scope, but instead, as an exemplification of one or more embodiments thereof. Many more variations are possible. For instance, the device can have other shapes, such as triangular, circular, oval, trapezoidal, square, rectangular, etc. The bridges can be thinner or wider, which alters the flexibility. The button passage can be narrower, wider, shorter, or longer. The cove may be smaller or larger. The tie slot may be wider, shorten or longer. The false knot may or may not be elastic. The Tiekeeper may not be convex, but flat or concave.

There are various possibilities with regard to how the device is connected to the necktie, therefore, the scope should be determined not by the illustrated embodiments, but by the claims and their legal equivalents.

I claim:

1. A necktie anchoring device for attaching a necktie to a shirt, the necktie having a false knot and long piece that generally extends over the buttons of a shirt along a longitudinal axis, the necktie anchoring device comprising: an angled body of material having a generally flat first section and a second section attached to the first section in a manner forming an angled shape to the angled body, the second section lying forward of the first section, the first section having a lead-in notch on one edge thereof and merging into a button passage which merges into a cove near the opposite edge, the lead-in notch, button passage, and cove being generally aligned along the longitudinal axis of the necktie such that the false knot is slid vertically downward to attach it to a shirt's top button's thread and slid vertically upward to remove it, and the second section having a generally triangular shape that is configured to be attached to the false knot of the necktie.

2. The device of claim 1 wherein said angled body is composed of polyethylene.

3. The device of claim 1 wherein the cove is configured for resting in position on a collar button thread.

4. The device of claim 1 wherein said angled body is made of bendable plastic material.

5. The device of claim 1 wherein said second member includes a tie slot through which a short back length of a tie can be inserted.

6. The device of claim 1 wherein said second member is sized to be located within the false knot of the necktie.

7. The device of claim 1 wherein said angled body is fixedly attached to the fake knot by a sewn joint.

8. The device of claim 1 wherein said angled body is fixedly attached within the false knot by a sewn joint.

9. A method of joining a necktie to a folded anchoring device, comprising the steps of: threading a narrow end of a shortened necktie through a hole located at the bottom of a false knot, pulling the narrow end up through the false knot and then slipping the narrow end down through a slot in the top of the folded anchoring device; draping the wide end of the shortened necktie over an angular shield section at the front of the folded anchoring device and checking the length to make sure it is the proper belt buckle length; pulling the false knot up over the shortened necktie and shield section; dangling any remainder of the narrow necktie end out of sight behind the device and the wide end of the necktie, and tucking it into a keeper loop or back into the false knot.

10. The method of claim 9 further comprising securing the folded anchoring device onto a shirt by sliding a butterfly section of the folded anchoring device vertically down behind a shirt's top button and guiding an accepting lead-in notch over the top button's threads, and passing the threads into a button passage until reaching a cove whereby the folded anchoring device rests on the threads of the shirt's top button that extend through the cove.

* * * * *